United States Patent [19]

Bos et al.

[11] 4,450,674

[45] May 29, 1984

[54] BACK ROTATION DEVICE FOR A CABLE STRANDING MACHINE

[76] Inventors: Johannes G. G. Bos; Hendricus J. P. M. Pollaert; Johannes L. H. Sijben, all of Edisonstraat 9, Venlo, Netherlands

[21] Appl. No.: 103,670

[22] Filed: Dec. 14, 1979

[30] Foreign Application Priority Data

Dec. 28, 1978 [NL] Netherlands ..... 7812593

[51] Int. Cl.[3] ..... H01B 13/04; D07B 3/00

[52] U.S. Cl. ..... 57/6; 57/3; 57/13; 57/293

[58] Field of Search ..... 57/3, 6, 9, 13–15, 57/59, 63, 64, 293, 294

[56] References Cited

U.S. PATENT DOCUMENTS

| | | | |
|---|---|---|---|
| 2,412,196 | 12/1946 | Ashbaugh et al. | 57/293 X |
| 2,530,726 | 11/1950 | Rasmussen | 57/293 X |
| 2,882,676 | 4/1959 | Bryan et al. | 57/293 X |
| 3,106,815 | 10/1963 | Nance et al. | 57/13 |
| 3,130,754 | 4/1964 | Bratz | 57/13 X |
| 3,133,402 | 5/1964 | Zwolinski et al. | 57/293 |
| 3,187,495 | 6/1965 | Christian, Jr. | 57/293 |
| 3,572,024 | 3/1971 | Lyons | 57/59 X |

FOREIGN PATENT DOCUMENTS

| | | |
|---|---|---|
| 1026205 | 3/1958 | Fed. Rep. of Germany . |
| 2215677 | 12/1973 | France . |

*Primary Examiner*—John Petrakes

[57] ABSTRACT

A stranding machine, particularly for making telecommunication cable, having a cage with feed reels, a take-up reel, and a back-rotation device which includes two eccentric discs journalled eccentrically with respect to each other in a rotatable guide ring. The discs have a plurality of corresponding bores in identical patterns, each pair of corresponding bores having an eccentric shaft journalled in the two bores so that eccentric motion of the discs causes the eccentric shafts to rotate. Each eccentric shaft has a bore for feeding a wire strand through it and a clamping member which rotates with the eccentric shaft for imparting torque to the strand, by driving the guide ring independently of the discs, so that back-rotation can be varied.

6 Claims, 5 Drawing Figures

BACK ROTATION DEVICE FOR A CABLE STRANDING MACHINE

BACKGROUND OF THE INVENTION

1. FIELD OF THE INVENTION

The invention relates to a standing machine for manufacturing cables, in particular communication cables, comprising a feed cage with feed reels, a stranding device, a take-up reel and a back-rotation device, the feed cage and the stranding device being rotatable with respect to each other.

During the stranding of cables and also during the armoring of a central cable with wire or with electrical conductors, various stresses are produced in the individual wire strands or conductors; that is, bending stresses, tensile stresses and notably torsional stresses are produced in the wires as they are twisted around their center lines during stranding in the direction of twisting, viewed in the running direction of the wires. The shape of such cables, which are subject to stress, is not stable. When a cable of this kind is split and/or cut, the torsional stresses cause breaking open and/or untwisting of the stranded unit or wires. The individual wires of a burst telephony cable are difficult to locate for making connections. In the case of armored cables, the armoring is liable to come loose over a comparatively long length.

The tendency to burst open can be simply reduced by at least partly eliminating the torsional stresses; to this end, the individual wires are rotated back, that is to say rotated around their center lines with a torsion opposing the stranding direction, so that a cable is obtained which has a stable shape and which does not tend to burst open.

In order to eliminate torsional stresses in the cores, machines for stranding wires to form a cable comprise a back-rotation or untwisting device. A description of the prior art, of this kind is known from German "Auslegeschrift" No. 1,026,205; this known machine has a rotatable feed cage with a central shaft on which the feed reels are mounted; for back-rotation of the wire strands, the feed reels are journalled to be freely rotatable in yokes which can be made to rotate, by a planetary drive, around an axis parallel to the center line of the central shaft and in a direction opposing that of the stranding direction. A drawback of this known device is in that the dimensions and the weight of the full feed reels and the maximum rotary speed of the feed cage, and hence the production speed, are limited by the comparatively high mass forces occurring and by the combined rotary and translatory movement of the feed reels. The back-rotation is 0° or 360°.

In another machine which is known from the published French Patent Application No. 2,215,677, these drawbacks are mitigated in that the back-rotation device is separated from the stationary feed reels and is driven at a continuously variable speed. However, this device has the drawback that, considering the construction of the back-rotation device, only a comparatively small number of wire strands can be processed.

SUMMARY OF THE INVENTION

The invention has for its object to provide a machine which is suitable for stranding wires to form a cable as well as for armoring of cables with a defined torsion or without torsion, which is capable of processing a very small number of wire strands as well as a comparatively large number of strands, and which enables continuous variation of the back-rotation effect from 0° to more than 360° at a very high production speed; if desired, even a negative back-rotation effect can be obtained, to increase torsion of the cores.

In accordance with the invention the back-rotation device comprises two discs which are rotatably journalled in a rotatable guide ring, eccentrically with respect to each other, eccentric shafts being journalled eccentrically in both discs with an eccentricity which equals that between the two discs, each eccentric shaft having an axial bore and a wire clamping member. With this structural arrangement a comparatively large number of eccentric shafts with clamping members can be accommodated in a very compact construction of the back-rotation device, so that a comparatively large number of wire strands (up to 72 in practice) can be simultaneously processed. The production speed of the device in accordance with the invention, being determined by the maximum rotary speed, is from two to three times higher than that of the known device.

Excessive noise is one of the drawbacks of the manufacture of cables. In order to improve working conditions, increasingly severe limitations on sound levels are imposed by the authorities. Thanks to the absence of yokes and planetary drives, the machine in accordance with the invention produces less noise than known machines and it better satisfies the requirements imposed.

In a preferred embodiment of the machine in accordance with the invention, both discs are journalled in the guide ring by way of rolling members, the outer cirumference of the discs and two annular guide paths on the inner circumference of the guide ring, which paths are eccentric with respect to each other, serving as bearing surfaces for the rolling members. Because of these features and a suitable choice of the eccentricity of the discs, the eccentric shafts and the guide paths on the inner circumference of the guide ring, the frictional forces and wear are minimized and the reliability of the device is increased.

The two discs are guided in the circumferential direction and in the radial direction by the rolling members which cooperate with the guide tracks and which act as a radial bearing. Positioning of the two discs in the axial direction is also achieved in a further embodiment of the back-rotation device in accordance with the invention, which is characterized by the use of spherical balls as rolling members, the guide paths being constructed as grooves. The balls, being partly located in the groove-like guide tracks, also act as an axial bearing and provide the positioning of the two discs in the axial direction.

For driving the back-rotation device, one of the two discs can be coupled to a drive shaft, and the guide ring can be driven by known means, the back-rotation device being journalled in an overhung manner. More rugged and vibration-free jounralling of the back-rotation device is realized in a further preferred embodiment of the machine in accordance with the invention in that the guide ring comprises a toothed ring, its outer circumference being rotatably journalled in a stationary supporting ring. The back-rotation effect can be accurately determined, by positive driving of the guide ring via a gearwheel which cooperates with the toothed ring.

The feed reels may be journalled in a stationary manner, in which case a rotatable stranding device is arranged behind the back-rotation device. However, in a further preferred embodiment of the machine in accordance with the invention, the feed cage is rotatable, one of the two discs being rigidly connected to the feed cage. Machines with a rotating feed cage, but without a back-rotation device and without back-rotation of the feed reels are generally known. Rather expensive devices of this kind can be connected to a back-rotation device having the described characteristics without excessive structural steps being required, so that a machine of this kind can thus also be used to manufacture torsion-free cables having a stable shape.

The invention will be described in detail hereinafter with reference to the accompanying diagrammatic drawing.

DESCRIPTION OF THE PREFERRED EMBODIMENT

Figure 1:
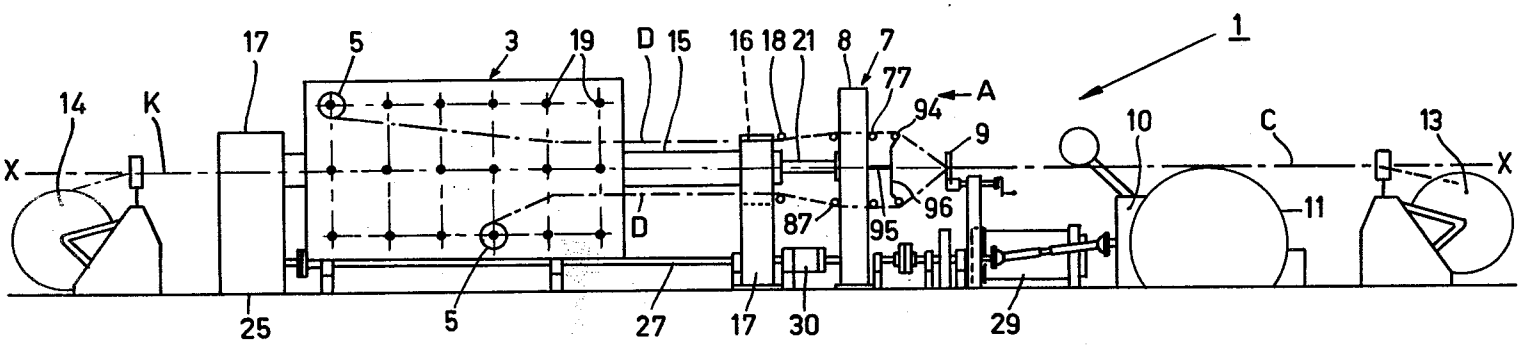
FIG. 1 is a diagrammatic side elevation of an embodiment of the device in accordance with the invention.
Figure 2:
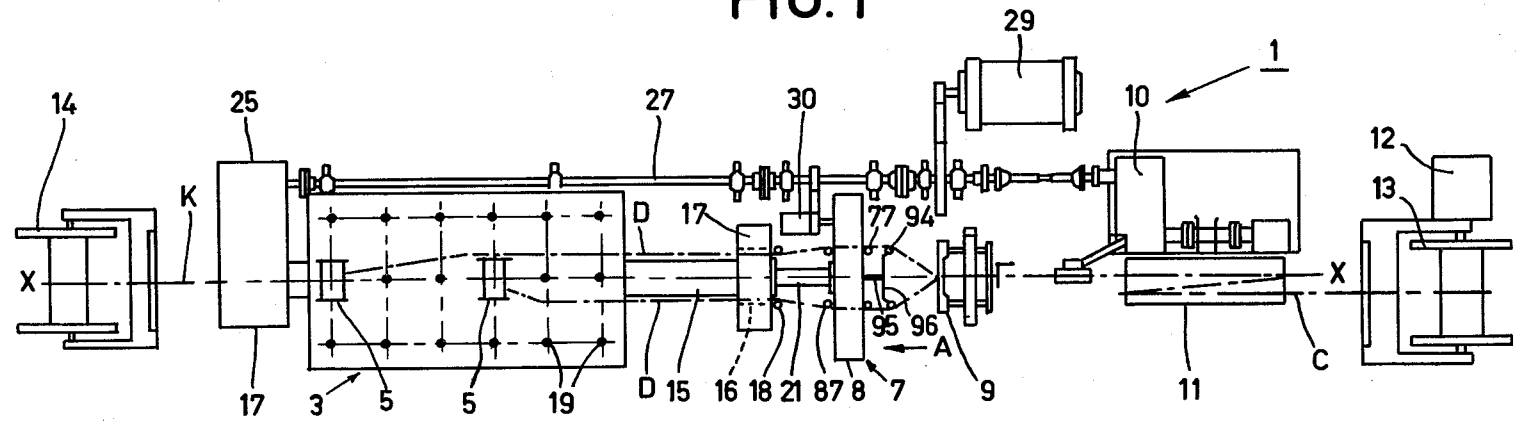
FIG. 2 is a plan view of the device shown in FIG. 1.

The device machine for stranding wires in order to form a cable as shown in the FIGS. 1 and 2 comprises a feed cage 3 with feed reels 5, a back-rotation device 7, a stranding nozzle 9, a pull-through disc 11, and a take-up reel 13. The feed cage 3 mainly consists of a hollow cage shaft 15 which is rotatably journalled in bearing blocks 17. The feed reels 5 are journalled to be freely rotatable on shafts in any known manner, these shafts being diagrammatically denoted by the reference 19 and being rigidly connected to the cage shaft 15 and uniformly spaced over the circumference and the length of the cage shaft. The drawing shows only a few feed reels for the sake of clarity. The back-rotation device 7 is coupled to the cage shaft 15 by a hollow coupling shaft 21. The reference X—X denotes the common center line of the feed cage 3, the back-rotation device 7 and the stranding nozzle 9. An electric motor 29 and a multiple drive shaft 27 drive the feed cage 3 via a switch box 25, the back-rotation device 7 via a variable speed drive or gearbox 30, and the pull-through disc 11 via a variable speed drive 10. The direction of rotation of the cage shaft 15 can be reversed by means of the switch box 25. The take-up reel 13 is driven by a separate motor 12.

Figure 3:
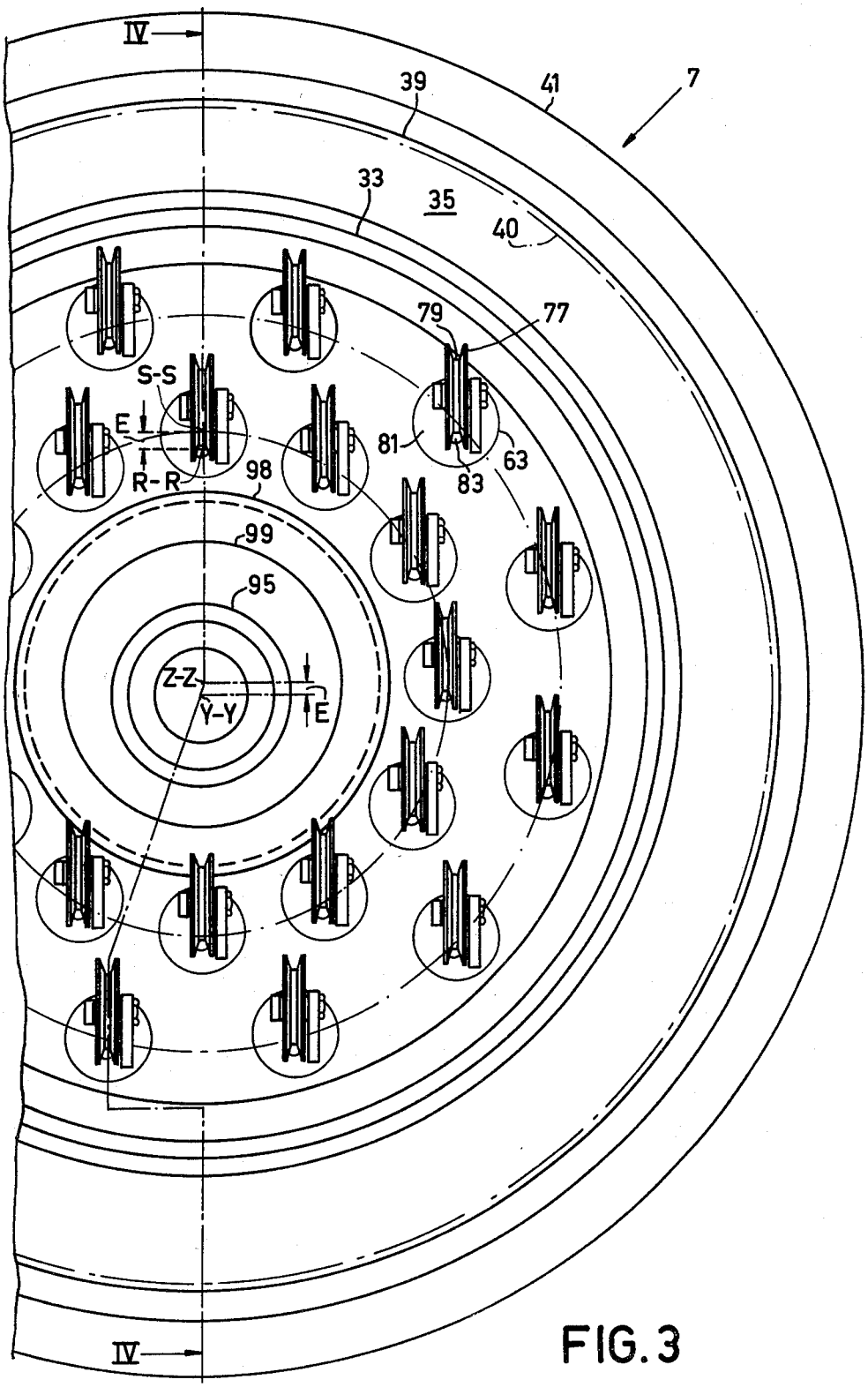
FIG. 3 shows the back-rotation device according to the arrow A in the FIGS. 1, 2 and 4 at an increased scale.
Figure 4:
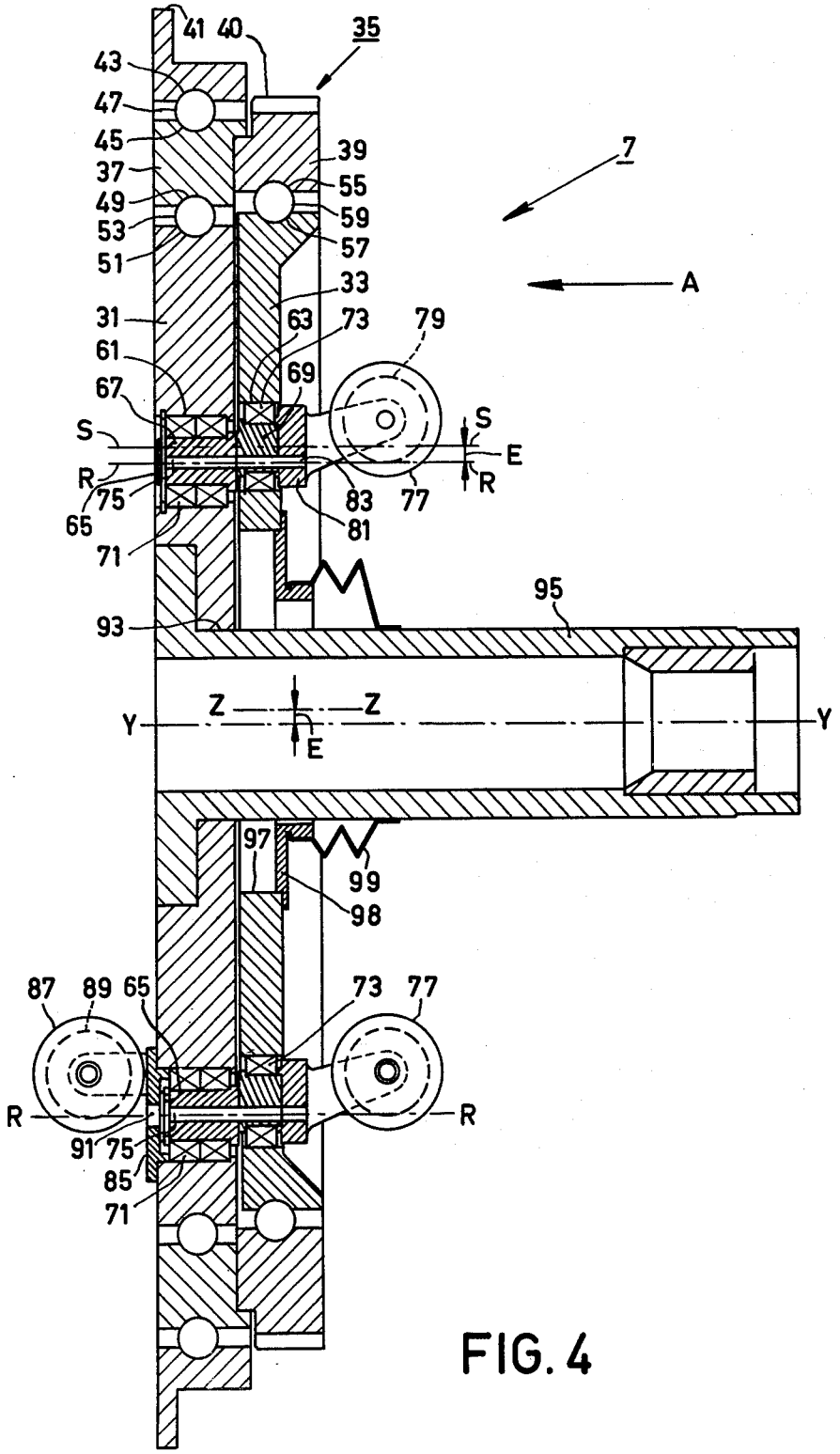
FIG. 4 is a sectional view of the back-rotation device taken along the line IV-IV in FIG. 3.
Figure 5:
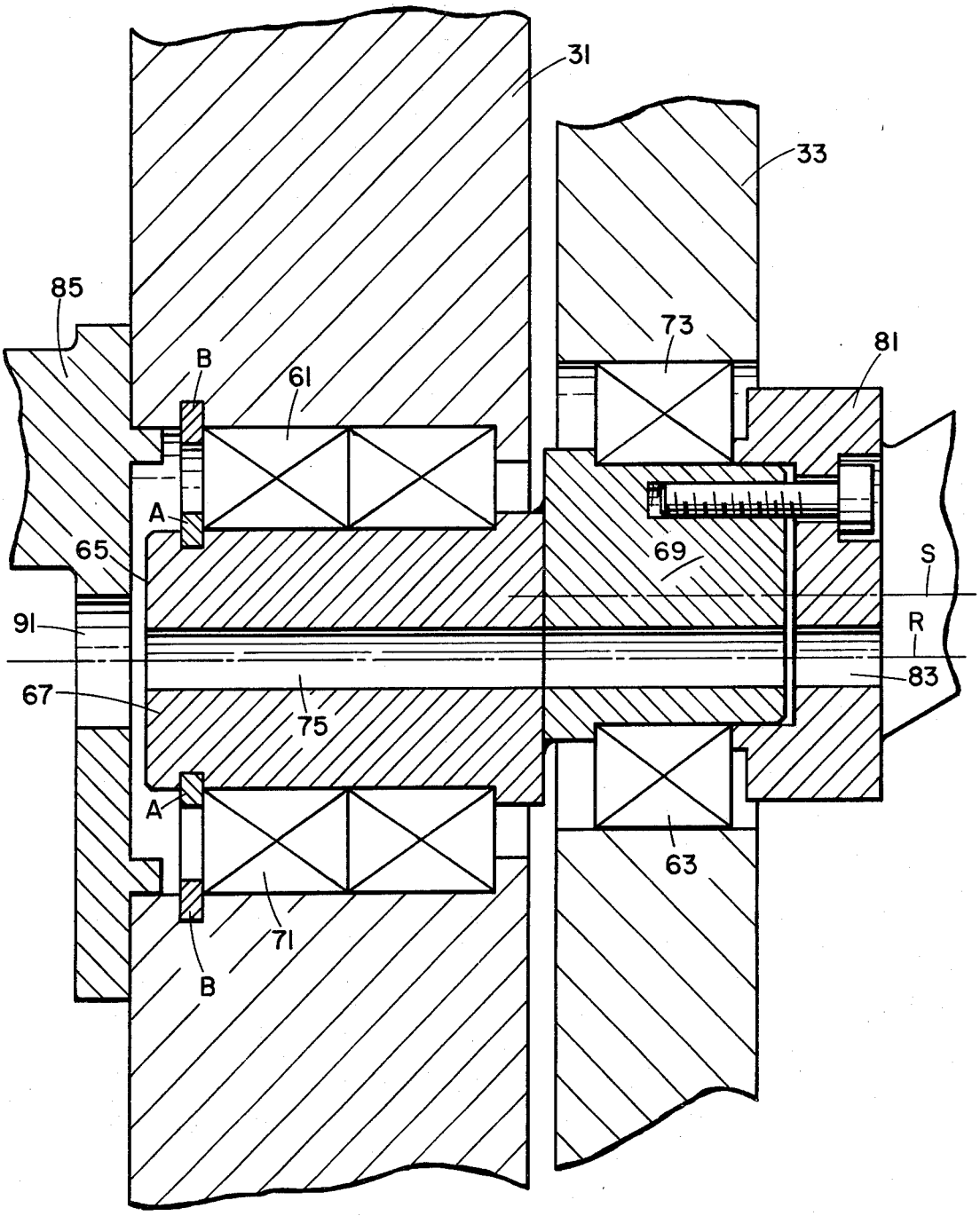
FIG. 5 is a sectional view on an increased scale of an eccentric shaft shown in FIG. 4.

As is shown in the FIGS. 3–5, the back-rotation device 7 comprises two discs 31 and 33, a guide ring 35 which is composed of two rigidly interconnected ring parts 37 and 39 and a supporting ring 41 which envelops the ring part 37. The inner circumference of the supporting ring 41 is provided with a groove corresponding groove 45 being provided on the outer circumference of the ring part 37. The grooves 43 and 45 serve as bearing surfaces for balls 47 by which the guide ring 35 is coaxially and rotatably journalled in the supporting ring 41. A groove 49 on the inner circumference of the ring part 37 and a corresponding groove 51 on the outer circumference of the disc 31 serve as bearing surfaces for balls 53 by which the disc 31 is rotatably and coaxially journalled with respect to the ring part 37 and the supporting ring 41. A groove 55 on the inner circumference of the ring part 39, eccentric with respect to the groove 45, and a groove 57 on the outer circumference of the disc 33 serve as bearing surfaces for balls 59 by which the disc 33 is rotatably and eccentrically supported with respect to the disc 31. The outer circumference of the ring part 39 is provided with a toothed ring 40. The reference Y—Y denotes the common center line of the disc 31, the ring part 37, the supporting ring 41 and the toothed ring 40. The reference Z—Z denotes the common center line of the groove 55 and the disc 33, this center centre line extending eccentrically with an eccentricity E with respect to the center line Y—Y.

The discs 31 and 33 are provided with an equal number of bores 61 and 63, respectively, arranged in identical patterns with respect to the respective disc center lines Y—Y and Z—Z. Eccentric shafts 65 having a journal part 67 and an eccentric part 69, repsectively, which are common to both discs, are each journalled in the corresponding bores of the two discs by means of roller bearings 71 and 73, respectively. The eccentricity of the eccentric shafts 65, that is to say the eccentricity of the center lines R-R and S-S of the journal part 67 and the eccentric 69 equals the eccentricity E of the two discs 31 and 33.

Thus the eccentric shafts prevent relative rotation between the discs but permit relative eccentric motion of the discs. Each of the eccentric shafts 65 is provided with a bore 75 which is coaxial to the journal shaft 67 and with a guide wheel 77 which serves as a wire clamping member and which is provided with a groove 79, the guide wheel being mounted, by means of a support 81, on the end face of the eccentric 69 so that a bore 83 in the support 81 and the bore 75 in the eccentric shaft 65 are aligned and that the groove 79 in the guide wheel 77 is substantially tangent to the center line R-R of the shaft 67. On the free side face of the disc 31 which is remote from the disc 33 at the area of the bores 61 guide rollers 87 are secured by holders 85. The guide rollers 85 have a groove 89 so that a bore 91 in the holders 85 is aligned with the bore 75 in the eccentric shafts 65, and that the groove 89 in the guide rollers 87 is substantially tangent to the center line R—R of the bore 75. The guide wheels 77 and the guide rollers 87 are preferably arranged so that the side faces of all guide wheels 77 are situated in parallel planes and that the side faces of the guide rollers 87 are situated in radial planes. For the sake of clarity, FIG. 4 shows only two guide wheels 77 and one guide roller 87 in parallel planes.

The disc 31 has a central bore 93 in which a hollow shaft 95 is secured so that the center line of the shaft coincides with the center line Y—Y of the disc 31. The disc 33 has a central bore 97 which is covered by a plate 98 and a diaphragm 99.

The supporting ring 41 is secured in the housing 8 of the back-rotation device 7, the disc 31 being coupled to the cage shaft 15 via the coupling shaft 21. The toothed ring 40 on the outer circumference of the ring part 39 serves, in conjunction with a gearwheel, for the driving of the guide ring 35 by the drive shaft 27. By means of the gearbox or variable speed drive 30 arranged between the drive shaft 27 and the toothed ring 40, the rotary speed of the guide ring 35 can be intermittently or continuously adjusted in both directions of rotation. For the correct guiding of the cores to be processed, the machine 1 also conmprises (diagrammatically shown in the FIGS. 1 and 2) bores 16 in the cage shaft 15, guide rollers 18 on the cage shaft between the bearing block 17 and the back-rotation device 7, and guide wheels 94 which are supported by a support 96 which is mounted on the hollow shaft 95.

The operation of the device will be described hereinafter. For stranding a number of wires D to form a cable C, full feed reels 5 are arranged on the shafts 19 of the cage shaft. The individual wires D are guided through the bores 16 in the cage shaft 15 and over the guide rollers 18 and the guide rollers 87, are inserted through the bores 75 of the eccentric shafts 65, are guided around the guide wheels 77 which serve as clamping members, are guided over the guide wheels 94, are threaded through the stranding nozzle 9, are guided around the pull-through disc 11, and are ultimately secured on the take-up reel 13. Subsequently, the motors 12 and 29 are started. Due to the rotation of the cage shaft 15 with respect to the stationary stranding nozzle 9, the wires D pulled from the feed reels 5 are stranded to form the cable C with a pitch which is dependent on the rotary speed of the cage shaft 15 and of the linear speed of the cable C in turn is determined by the rotary speed of the pull-through disc 11. During the stranding, the individual wires D are twisted, due to the relative rotary movement of the cage shaft 15 and of the stranding nozzle 9, viewed in the stranding direction, in the running direction of the wires D. The torsional stresses thus produced in the wires D are partly or completely eliminated or are even overcompensated for by back-rotation of the individual wires through a given angle by means of the back-rotation device. The disc 31 is driven by the cage shaft 15 at the same rotary speed and in the same direction of rotation and takes along the disc 33 via the eccentric shafts 65. The back-rotation effect is then determined by the relative rotary speed and the direction of rotation of the guide ring 35 on the one hand and the discs 31 and 33 on the other hand.

With the ring 35 at a standstill, the two discs 31 and 33 perform a relative eccentric motion, with the result that the eccentric shafts 65 are each rotated around the center line R—R of their journal parts 67 through an angle of 360° per revolution of the two discs and hence per revolution of the cage shaft 15. The direction of rotation of the eccentric shafts then oppose that of the discs. The wires D guided around the guide reels 77 are rotated back through an angle of 360°, with the result that the torsional stresses in the wires D are at least for the greatest part eliminated.

When the guide ring 35 is driven at the same rotary speed as the cage shaft 15 but in the opposite direction of rotation, both discs perform an accelerated relative eccentric movement, with the result that the eccentric shafts 65 are rotated twice through an angle of 360° per revolution of the discs in a direction of rotation which opposes that of the discs; the torsional stresses can thus be overcompensated for.

When the ring 35 is driven at the same speed of rotation and in the same direction of rotation as the cage shaft 15 and the two discs, no relative eccentric movement of the discs takes place and hence no rotation of the eccentric shafts 65; the back-rotation angle is 0° and the torsional stresses in the conductors are not compensated for. The latter situation corresponds to the situation where the back-rotation device is de-activated and will hardly occur in practice. In back-rotation of the cores is not necessary or not desirable, the back-rotation device can be de-activated by omitting the guiding of the wires D over the guide wheels 77 which thus no longer act as clamping members.

It will be clear that any desirable torsion effect on the individual wires can be obtained by variation of the rotary speed and by variation of the direction of rotation of the guide ring 35. If the rotary speed of the guide ring 35 is gradually increased from standstill until it equals the rotary speed of the cage shaft 15, the direction of rotation being the same as that of the cage shaft, the back-rotation decreases from 360° to 0°. In the case of a rotary speed which is higher than that of the cage shaft 15, the wire strands are not rotated back, but are twisted further, so that the torsional stresses can increase to a maximum value. When the guide ring 35 is driven from standstill at an increasing rotary speed in a direction which opposes the direction of rotation of the cage 15, the back-rotation increases from 360°.

In the embodiment described above, wires D are stranded to form a cable C. The wire strands D can alternatively be stranded around a core cable or core wire K which is pulled from a feed reel 14 and which is fed through the hollow cage shaft 15, the hollow coupling shaft 21, the shaft 95 and the stranding nozzle 9 where the wires D are stranded around the core cable C. As far as the back-rotation of the wires D is concerned, the operation is then as described above.

The device can be used equally effectively for notably the assembling of cables in layers of strands or for armoring cables where a cable K is fed and provided with a multi-strand armor of steel wire, with or without a jacket of a synthetic material, wire-like armouring strands, for example, steel wire, then being stranded around the cable K in the described manner with defined torsion and a stable shape.

Generally, back-rotation of more than 360° will be used in order to compensate for the elastic springing back of the wires strand after the back-rotation. In given cases overcompensation has even been found to be effective, because the shape stability can thus be further improved. The degree of back-rotation is dependent of the dimensions and the material of the wire and also of the pitch of the stranded wire in the cable and of the cable diameter.

The device in accordance with the invention is notably characterized by a very compact construction of the back-rotation device 7. In a practical embodiment, the ring 35 has a maximum external diameter of 830 mm, and 36 eccentric shafts 65 with an equal number of guide reels 77 were mounted in the discs 31 and 33. Thus, the embodiment was suitable for the simultaneous processing of 36 wires or conductors.

In the described embodiment, the rotating parts are driven, with the exception of the take-up reel 13, by a single electric motor via a common drive shaft. It will be clear that the individual parts can alternatively by driven by individual motors. The scope of the invention also covers mechanical equivalents of given elements; for example, the balls for the jounralling of the discs may be replaced by cylindrical roller members or by a sleeve bearing; the guide ring which consists of two parts may alternatively consist of one part; instead of the guide wheels which serve as clamping elements, use can also be made of other suitable members.

The device in accordance with the invention is suitable for the manufacture of steel cables as well as electrical cables, notably telephone cables. Furthermore, the device can be used for introducing twists in molded quad units for telephone cables; in the case of eccentrically molded cores, the eccentricity is then distributed over the quad length, so that the K value for a telephone quad thus stranded is reduced.

What is claimed is:

1. A stranding machine for manufacturing cables, particularly communication cables, comprising a feed cage having feed reels, a stranding device, a take-up reel, a back-rotation device, a central shaft, and means for rotating the feed cage and the stranding device with respect to each other about the central shaft axis, characterized in that the back-rotation device comprises a guide ring rotatable about said central shaft axis, having first and second annular guide paths which are eccentric with respect to each other with a given eccentricity, first and second discs rotatably journalled in said first and second guide paths respectively, said discs having a plurality of respectively corresponding bores arranged in identical patterns about the center lines of the respective discs, a plurality of eccentric shafts, each shaft having a journal part journalled in a bore of said first disc and an eccentric part journalled in the corresponding bore of the second disc, said journal part and eccentric part having a relative eccentricity equal to said given eccentricity whereby said discs are restrained from rotation relative to each other and upon relative eccentric motion of said disc said eccentric shafts are rotated, each eccentric shaft having a bore for passing a wire strand there through, a respective plurality of clamping members each associated with and connected to a respective eccentric shaft for rotation with said respective shaft, said clamping members being arranged to impart a torque to a wire strand passing through the respective eccentric shaft bore responsive to rotation of the eccentric shaft, said torque being applied about the longitudinal axis of the wire strand, and means for rotating said guide ring.

2. A machine as claimed in claim 1, characterized in that said first annular guide path is concentric with said central shaft, and said eccentric shaft bores are coaxial with the respective journal parts, whereby each eccentric shaft bore has a constant distance from the central shaft axis as the guide ring is rotated with respect to the discs, and upon rotation of said guide ring said eccentric shafts rotate about their respective bores.

3. A machine as claimed in claim 2, characterized in that said first and second discs have respective outer circumferences, and said device further comprises rolling members respectively disposed between said first disc outer circumference and first annular guide path, and the second disc outer circumference and second guide path, for journalling the discs in the guide ring.

4. A machine as claimed in claim 3, characterized in that said rolling members are balls and the guide paths are grooves.

5. A machine as claimed in claim 1, characterized in that said device comprises a stationary supporting ring in which an outer circumference of the guide ring is journalled and said means for rotating the guide ring icnludes a toothed ring on the guide ring.

6. A machine as claimed in any one claims 1–5, characterized in that the feed cage is rotatable about said central shaft axis and the first disc is rigidly connected to the feed cage.

* * * * *